United States Patent [19]

Riedel

[11] 4,102,643

[45] Jul. 25, 1978

[54] DECATIZING OF FABRICS

[76] Inventor: Dieter Riedel, 4952 Porta Westfalica-Hausberge, Turmblick 6, Fed. Rep. of Germany

[21] Appl. No.: 736,238

[22] Filed: Oct. 27, 1976

Related U.S. Application Data

[63] Continuation of Ser. No. 637,051, Dec. 2, 1975, abandoned.

[30] Foreign Application Priority Data

Dec. 2, 1974 [DE] Fed. Rep. of Germany ..... 2456921

[51] Int. Cl.[2] ..... D06C 15/06

[52] U.S. Cl. ..... 8/149.3; 34/123; 68/5 R

[58] Field of Search ..... 8/149.1, 149.3; 68/5 R, 68/5 B, 5 D, 5 E, 8; 34/111, 116, 117, 118, 123, 23, 37

[56] References Cited

U.S. PATENT DOCUMENTS 3,046,771 7/1962 Bailey ..... 68/5 E

FOREIGN PATENT DOCUMENTS 2,213,429 10/1973 Fed. Rep. of Germany ..... 68/5 D 1,185,411 3/1970 United Kingdom ..... 68/8

*Primary Examiner*—Philip R. Coe

*Attorney, Agent, or Firm*—Mason, Mason & Albright

[57] ABSTRACT

Decatizing apparatus comparison a heated cylinder and a backing cloth applied against the cylinder by means of a thrust belt under high tension. The material to be treated passes between the cylinder and the backing cloth. The cylinder is freely rotatable and is driven by passage of the material, the backing cloth and the thrust belt.

2 Claims, 1 Drawing Figure

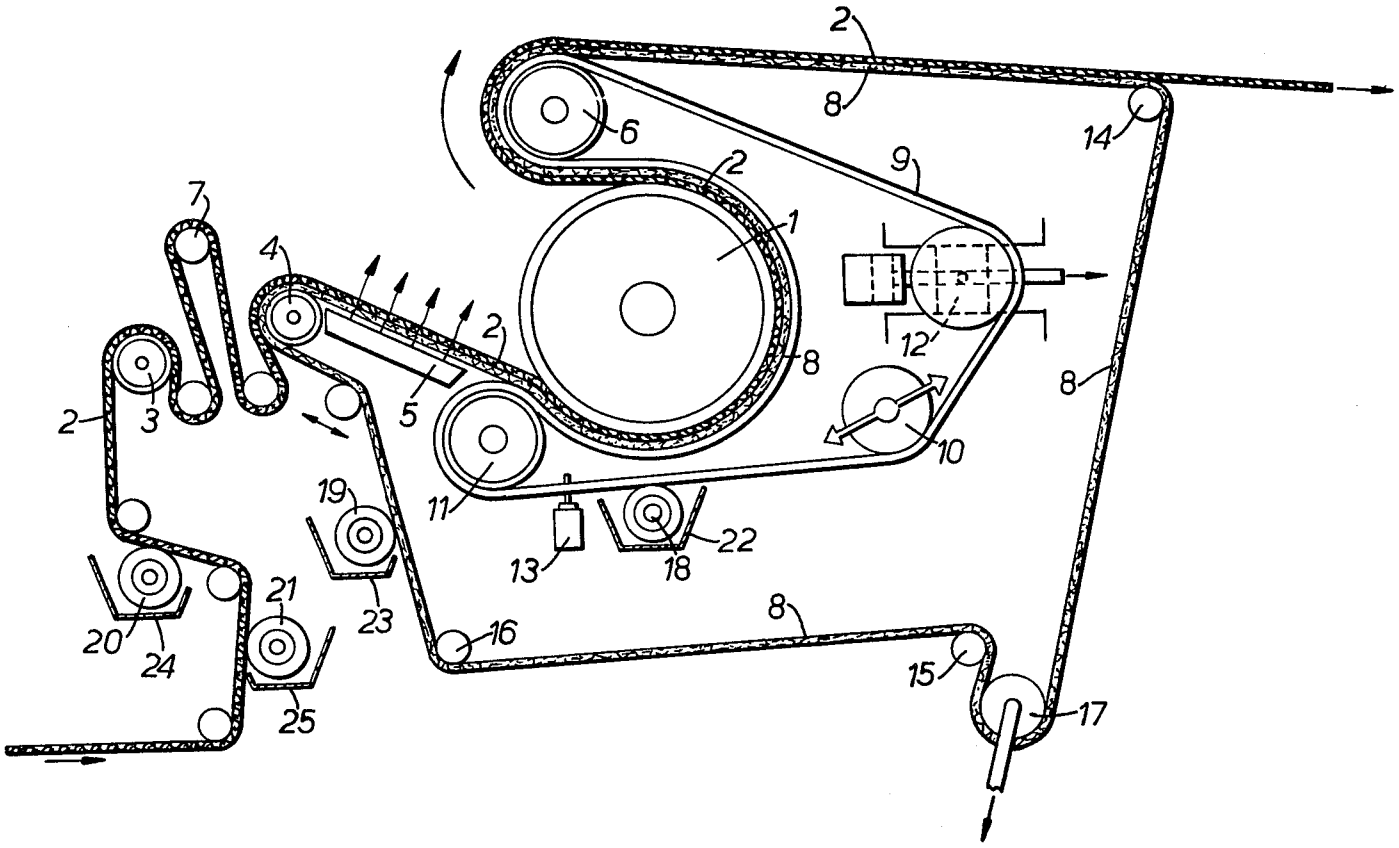
1
2
3
4
5
6
7
8
9
10
11
12
13
14
15
16
17
18
19
20
21
22
23
24
25

DECATIZING OF FABRICS

This is a continuation of application Ser. No. 637,051 ;l filed Dec. 2, 1975, and now abandoned.

BACKGROUND OF THE INVENTION (1) Field of the Invention

The present invention relates to the continuous decatizing of woven, knitted and other fabrics.

(2) Description of the Prior Art

There has been proposed a decatizing process in which the material to be treated is pressed between a rotated, heated, cylinder having its own drive system, and a heated trough in order to consolidate the material. The cylinder entrains the material and drags it over and beyond the trough. As a result of this treatement, the material has a shiny surface at least on the side of the material facing towards the trough.

This previously proposed process is disadvantageous in that the material is elongated longitudinally during the treatment. Elongation of the material of the order of magnitude of 2 to 5% occurs. The purchasers of the material, will, however, accept a maximum tolerance of plus or minus 1%. A material which shrinks by more than plus or minus 1% during the so-called "ironing test," is useless for further processing since it causes shrinkage folds or creases in a garment made from the material. The cloth manufacturer can reduce the internal strain condition of the material to the acceptable value, only by a shrinking process. However, this shrinking process, which is usually performed by a steaming operation, adversely affects the previously obtained pressing and decatizing effect.

For these reasons, a compromise solution is implemented by using a very low contact pressure between the material and the cylinder. Although in this manner, the elongation of the material is kept within permissible limits, the resulting pressing effect leaves much to be desired.

There has also been proposed a decatizing process using apparatus comprising a heated cylinder, an inner backing cloth which is conveyed over a humidifying device prior to reaching the cylinder, and an outer backing cloth which surrounds the cylinder, the material to be treated, and the inner backing cloth in the area of the cylinder. There is no significant contact pressure applied between the material and the cylinder with the result that the material is not properly finished. Also, owing to the absence of applied pressure the material is likely to slip which results in an unacceptable elongation of the material and in a moire effect on the material, this latter effect being caused by slip between the cylinder and the backing cloths.

SUMMARY OF THE INVENTION

According to the invention, there is provided a method for the continuous decatizing of a fabric material using a rotatable, heated, cylinder, a moisturizing device, a backing cloth, said backing cloth passing across the moisturizing device and around the cylinder. The material is fed between the cylinder and the backing cloth with the material being in direct contact with the surface of the cylinder, and a thrust belt is provided under high tension to thrust the backing cloth and the material against the cylinder.

BRIEF DESCRIPTION OF THE DRAWING

An embodiment of the invention will now be described, by way of example only, with reference to the accompanying diagrammatic drawing, the sole FIGURE of which is a section of decatizing apparatus for carrying out the method in accordance with the invention.

DESCRIPTION OF THE PREFERRED EMBODIMENT

As shown in the drawing, the apparatus comprises a heated cylinder 1, which is freely rotatable, the cylinder 1 being rotated simply by passage of the material 2 to be decatized, an associated backing cloth 8 and a thrust belt 9. The surface of this cylinder 1 has a mirror finish and is completely smooth. The cylinder 1 is heated to a constant, but controllable, temperature of 110° to 180° C, and is journalled in ball-bearings in a smooth-running manner.

The material 2 is fed from a stack (not shown) over a series of rolls including a feed roll 3, and a roll 4, over a moisturizing device 5, around a part of the cylinder 1, and around a drive roll 6 and is then fed to a folding device (not shown).

The moisturizing device 5 may, for example, comprise a perforated box from which steam, and in particular saturated steam, flows out freely. Alternatively the moisturizing action can be effected by means of fine spray of water. The moisturizing device 5 acts to improve the pressing and decatizing action.

The feed roll 3 acts to draw the material 2 off the stack with a minimum tension. A stationary rod 7 which is intended for manually straightening material having a distorted weft, is situated between the two rolls 3 and 4. The material 2 passes over this rod 7, during its passage from the stack to the cylinder 1.

The backing cloth 8 consists of an endless and seamless belt of satin, felt or other suitable material. Among other purposes, the backing cloth acts as a conveyor belt for the material 2.

A part of the cylinder 1 is surrounded by the thrust belt 9 which is formed from a strip and is free of projections at the point of connection of the two ends of the strip. The thrust belt 9 consists of, for example, a high-strength synthetic felt, metal, or rubber with a reinforcing insert and the like, and is intended to bear and transmit high tensile forces. The thrust belt 9 is entrained around the drive roll 6 and freely rotatable rolls 10 and 11. The rolls 6 and 11 are heated and maintain the thrust belt 9 at the treatment temperature. A tensioning device 12 which enables the tension of the thrust belt 9 to be adjusted steplessly and to be kept constant throughout the decatizing operation is incorporated on the path of movement of the thrust belt 9.

The roll 10 also serves the purpose of laterally guiding the thrust belt 9. Contact sensors 13 which are situated at either side of, and spaced from, the thrust belt 9, effect an axial displacement of the roll 10 via electrical or pneumatic switching elements (not shown). An inclined setting of the roll 10 is produced by such axial displacement, so that the thrust belt 9 is consequently displaced sideways. In this manner the thrust belt 9 can be maintained in a central position at all times.

The backing cloth 8 acts to prevent the thrust belt 9 from marking the material 2. The backing cloth 8 which has a dense and smooth surface, is interposed between the thrust belt 9 and the material 2 and does not leave on the material 2 any imprints of the comparatively coarse structure of the thrust belt 9. The high radial stress exerted on the material 2 by the thrust belt 9 is thus transmitted to the material 2 by the backing cloth 8, and the material 2 is pressed against the periphery of the cylinder 1.

The material 2 is conveyed across the moisturizing device 5 and around the cylinder 1 without elongation by virtue of the fact that the material 2 is supported and moved by the backing cloth 8; the displacement of the thrust belt 9, the backing cloth 8, and of the material thus occur completely free of slipping in these two areas.

The backing cloth 8 moves along a common path with the thrust belt 9 in the pressing area of the cylinder 1; outside this area and behind the drive roll 6, the backing cloth 8 and the thrust belt 9 follow separate paths, the backing cloth 8 passing over guide rolls 14, 15 and 16 and a tensioning roll 17.

Brushes 18, 19 are associated with the thrust belt 9 and the backing cloth 8 to ensure that the surface of the belt 9 and the surface of the backing cloth 8 remain free of dirt and fluff and other matter.

The material 2 is also brushed on both sides prior to the moisturizing and pressing actions. This is effected by means of brushes 20, 21. Each of the brushes 18 to 21 is equipped with a box 22 to 25, respectively, for receiving matter removed by the brushes, the boxes 22 to 25 being in communication with a suction device (not shown).

The apparatus described may be used as a thermal printing machine, in which transfer paper or thermal printing paper is fed through the apparatus synchronously with the material 2 and the backing cloth 8. In this case, however, the force applied by the tensioning device 12 is reduced, so that the pressure between the material 2, the paper and the cylinder 1 does not become excessive.

The apparatus operates in the following manner:

The material 2 fed from the stack is conveyed by the backing cloth 8 in stress-free and slip-free manner over the roll 3, the rod 7 and the roll 4 and over the moisturizing device 5. In view of the freedom from slipping, there is thus no speed differential between the material 2 and the backing cloth 8.

Following moisturization, the material 2 is conveyed into the pressing area of the heated cylinders 1. The material 2 is pressed and steamed by the thrust belt 9 via and the backing cloth 8. The displacement of the thrust belt 9, the backing cloth 8, the material 2, and the cylinder 1 is effected by frictional engagement of the thrust belt 9 with the drive roll 6, and no relative displacement occurs between the thrust belt 9, the backing cloth 8, the material 2 and the cylinder 1. The material 2, which is thus ironed and pressed, has improved handling properties and is not liable to shrinkage, and is fed from the roll 6 to a folding device (not shown), in a state suitable for use.

In the apparatus particularly described, the material is conveyed and processed without elongation and due to the absence of elongation the finished material has good properties. Also, the material is free from a moire effect due to the high pressure applied by the thrust belt and due to the fact that the cylinder lacks its own drive means.

The endless and slip free backing cloth of satin or other appropriate material, which moves with the thrust belt, fulfils two important functions. On the one hand, the backing cloth which has a very dense and smooth surface, does not mark the material so that the relatively rough surface of the thrust belt is not impressed on the surface of the material; on the other hand, the backing cloth serves the purpose of stretch-free conveyance of the material.

The material is moved through the moisturizing zone free of elongation by means of the backing cloth, which acts as a conveyor belt. The steaming or other moisturizing operation, which has beneficial effects on the final condition of the material, is, in the previously proposed apparatus accompanied by an unacceptable elongation of the material. As is known, a steamed material is extremely delicate and easily deformable, so that not only an elongation of the material, but at the same time also a decrease in the width of the material, must be expected as a consequence of this elongation. These effects do not, however, arise in the apparatus described since the material is carried through the moisturizing zone by means of the backing cloth and also because the feed roll draws the material from the stack and feeds it to the backing cloth.

Elongation of the material does not occur throughout the contact period, since all the parts move without slipping. Evaporation of moisture occurs from the material on the cylinder with the result that both a pressing and a decatizing action is effected due to the high contact pressure between the material and the cylinder along a relatively large path length.

What is claimed:

1. A method of continuously decatizing and effectively pressing a fabric material said method comprising: providing a feed path for the fabric material; providing a rotatable, heated, decatizing cylinder on said feed path having a continuous mirror finish surface; providing a moisturizing device on said feed path upstream of said decatizing cylinder, continuously feeding a backing cloth having a dense and smooth surface across said moisturizing device and around said mirror finish surface of said decatizing cylinder, continuously feeding the fabric to be treated along said feed path whereby the fabric passes across said moisturizing device and across said mirror finish surface of said cylinder in direct contact with said mirror finish surface of the cylinder, with the fabric being located between said mirror finish surface of said cylinder and the adjacent said dense and smooth surface of said backing cloth; and providing a thrust belt under high tension to thrust said backing cloth and the fabric material towards said mirror finish surface of said cylinder, whereby elongation of the fabric does not occur throughout the period of said direct contact with said mirror finish surface of said cylinder and the fabric thus ironed and pressed has improved handling properties.

2. A method according to claim 1, wherein the thrust belt is non-permeable to air.

* * * * *